United States Patent [19]

Piso

[11] Patent Number: 4,842,160

[45] Date of Patent: Jun. 27, 1989

[54] FLOATING COVERING FOR LIQUID STORAGE TANK

[76] Inventor: Bastiaan D. F. Piso, St. Michielweg 13, Curacao, Netherlands Antilles

[21] Appl. No.: 143,948

[22] PCT Filed: Apr. 16, 1987

[86] PCT No.: PCT/NL87/00008

§ 371 Date: Dec. 14, 1987

§ 102(e) Date: Dec. 14, 1987

[87] PCT Pub. No.: WO87/06211

PCT Pub. Date: Oct. 22, 1987

[30] Foreign Application Priority Data

Apr. 17, 1986 [NL] Netherlands ..... 8600974

[51] Int. Cl.[4] ..... B65D 88/48; B65D 88/50

[52] U.S. Cl. ..... 220/225; 220/226

[58] Field of Search ..... 220/225, 226, 222, 221, 220/220

[56] References Cited

U.S. PATENT DOCUMENTS

| | | | |
|---|---|---|---|
| 1,674,038 | 6/1928 | Glass | 220/221 |
| 2,085,752 | 7/1937 | Horton et al. | 220/225 |
| 4,406,377 | 9/1983 | Bruening | 220/221 X |

FOREIGN PATENT DOCUMENTS

| | | | |
|---|---|---|---|
| 883770 | 12/1961 | United Kingdom | 220/225 |

*Primary Examiner*—Donald F. Norton
*Attorney, Agent, or Firm*—John P. Snyder

[57] ABSTRACT

A floating covering on the liquid content of a storage tank. The circumferential edge of the covering has an elastic annular body provided with a gas-tight annular chamber and an annular body of foam material. Pressure control means communicates with the chamber for selectively pressurizing and releasing pressure from the chamber.

11 Claims, 2 Drawing Sheets

Figure 3:
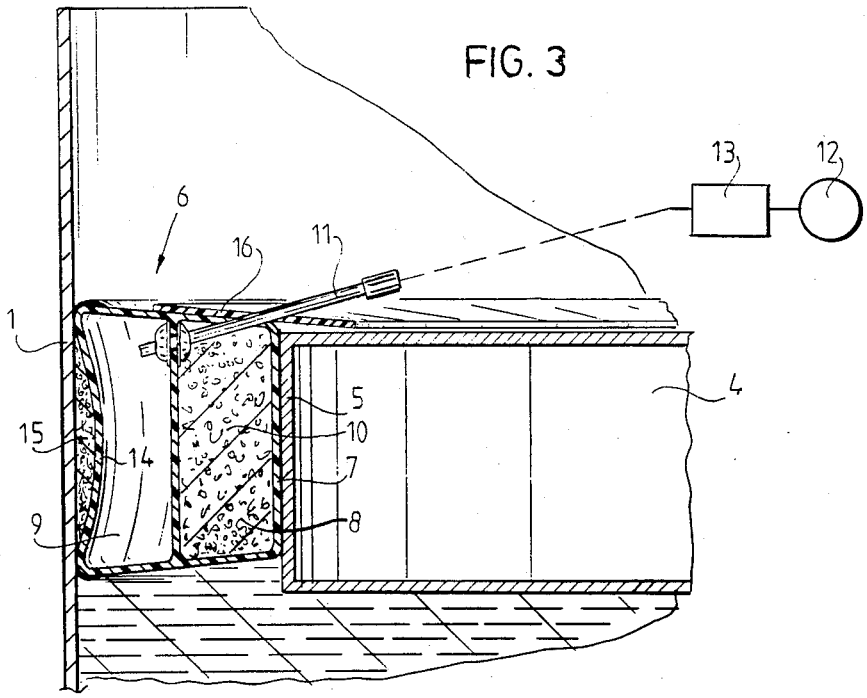

FIG.1
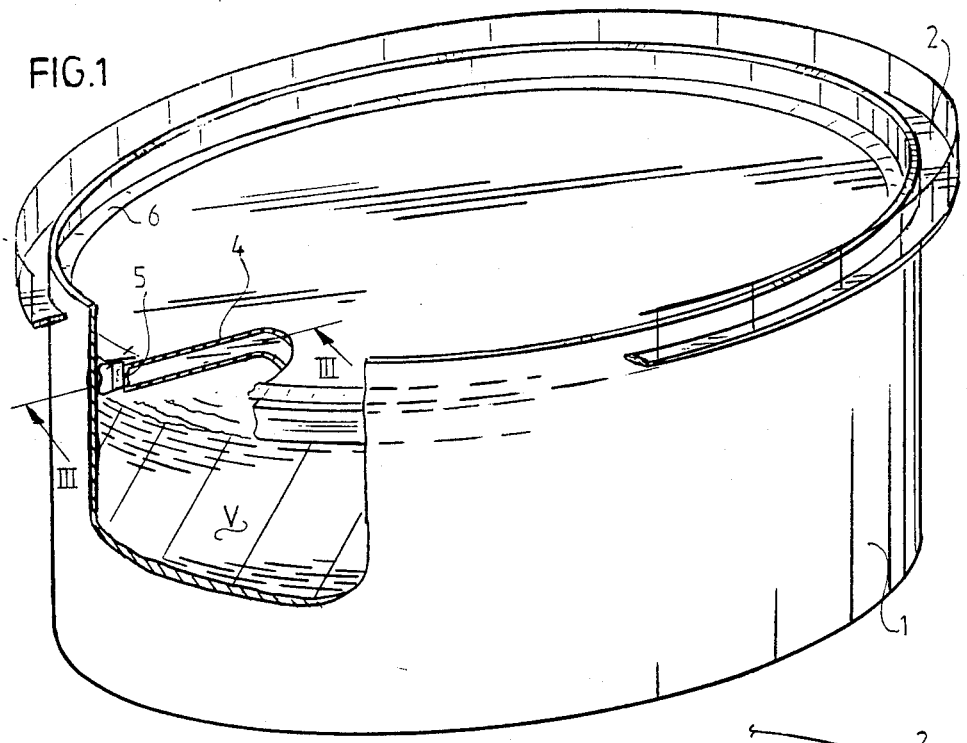
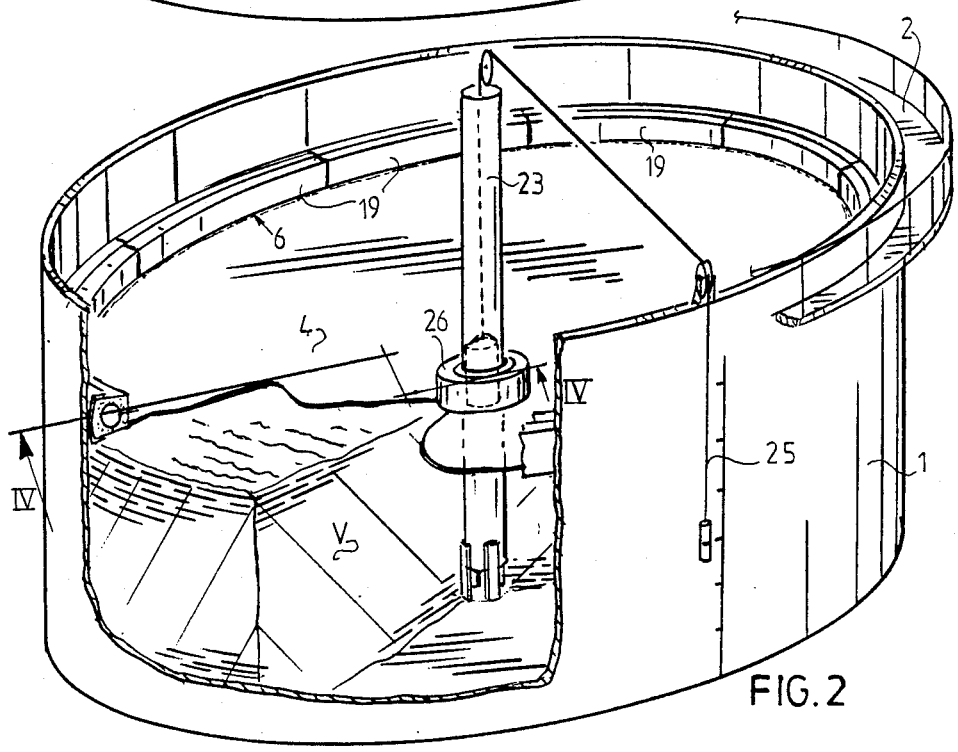
FIG.2

FLOATING COVERING FOR LIQUID STORAGE TANK

The invention relates to a floating covering on the liquid content of a storage tank with vertical side wall.

In order to prevent evaporation of the stored liquid the storage tank is provided with a floating covering which is arranged in the tank for movement up and down with the level of the liquid. In known constructions there is a comparatively large gap between the floating covering and the tank wall, this gap becoming such a large surface in large tanks that a relatively large amount of liquid continues to evaporate. This is a drawback particularly with volatile liquids and with storage in hotter regions.

The invention has for its object to obviate the above stated drawback and provides for this purpose a floating covering which is distinguished in that the circumferential edge of the covering is provided with an annular closing body of elastic material lying against the tank side wall.

If the storage tank is formed with stand pipes it is recommended according to the invention that the or each pipe is likewise enclosed with a closing body of elastic material that is connected to the covering.

In order to prevent large friction losses and therefore not to make emptying and pumping full of the storage tank difficult, it is advantageous to form the closing body with a hollow gas-tight annular space which can be connected up to a pressure source. By relieving pressure in the annular space the closing body can retract slightly, as a result of which friction is reduced. As soon as the required liquid level is reached the hollow body can be connected onto the pressure source so that the closing body is "inflated" up against the side wall.

A particularly advantageous embodiment is obtained by constructing the closing body of a number of segments to be threaded onto a hose functioning as a hollow space. Such a construction lowers the manufacturing costs and facilitates assembly.

An exceptionally light construction for a floating covering is achieved by arranging a sheet type layer of flexible material between the closing bodies.

If use is made of the segments, assembly can be simplified even further by making the connection between each segment and the sheet of the releasable type, for example a zip fastening.

The invention is further elucidated in the figure description following below.

Figure 4:
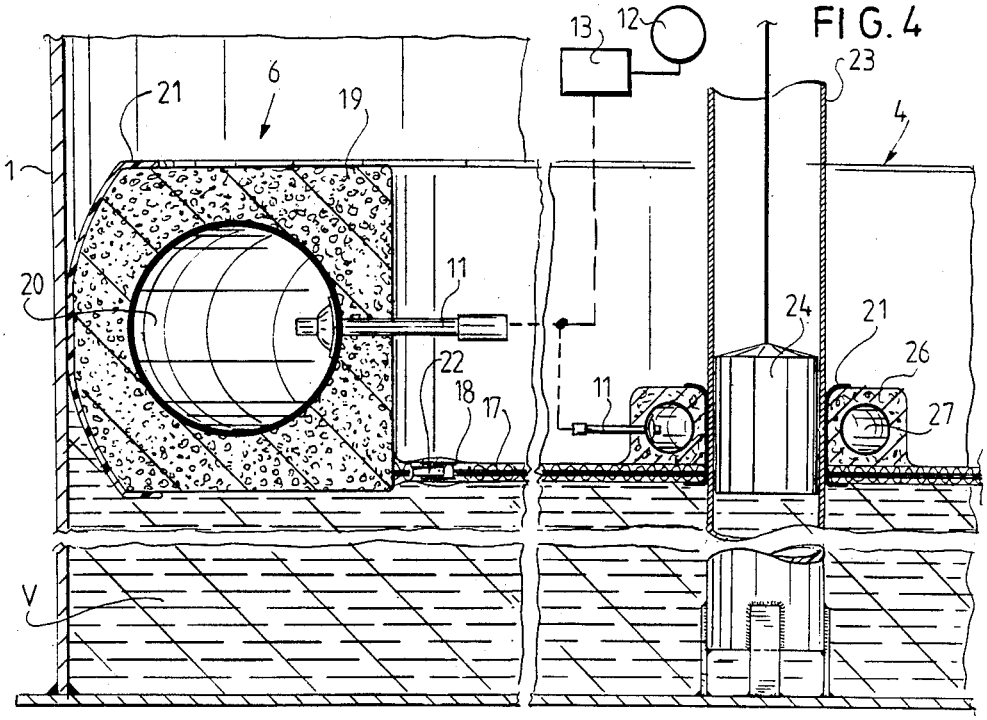

In the drawing:

FIG. 1 shows a perspective view of a storage tank, of which the peripheral wall and roof covering is partly broken away, the tank being provided with a floating covering according to a first embodiment of the invention, FIG. 2 shows a view corresponding with FIG. 1 of a storage tank provided with a floating covering according to a second embodiment of the invention, FIG. 3 shows a section along the line III—III in FIG. 1, and FIG. 4 a section of the floating covering along the line IV—IV in FIG. 2.

A storage tank as according to FIG. 1 and 2 consists of a base, not described further, in which is arranged an upright wall in a liquid-tight manner. The upper edge of wall 1 is provided with a cat walk 2.

Via feed and discharge means (not shown) a liquid V is respectively fed into and discharged from the tank. Remaining at the liquid level is a covering 4, which can have a random construction.

The covering in FIG. 3 is a hollow disc formed of metal, of which the circumferential edge 5 lies at an interval from the tank wall 1. As a result of disc 4 having a sufficiently large volume a determined buoyancy is created, sufficient to allow the covering to float on the liquid.

To prevent evaporation along the gap between the circumferential edge 5 and tank wall 1 a closing body 6 is arranged according to the invention. This closing body bridges the said gap.

The floating body as in FIGS. 1 and 3 takes the form of an annular body of for example rubber material 7, which is formed with two chambers 8 and 9. The chamber 8 located against floating covering 4 is filled with a body of flexible material 10, for example foam substance. The second chamber 9 takes a hollow form and is connected via a connecting pipe 11 to a pressure source 12, with which is associated a control system 13 which is not described further.

The wall of chamber 9 facing towards tank wall 1 takes a slightly arched form, such that there remains a lens shaped space between this arched wall 14 and tank wall 1. This lens shaped space 15 is filled with a substance with a low coefficient of friction, for example Teflon.

In view of the fact that the buoyancy between disc 4 and ring 6 can vary with different liquids it is recommended that the connection between ring 6 and disc 4 is secured. This is done here for example with a rigid annular strip 16 which connects the upper part of disc 4 to that of ring 6.

The above described covering is used as follows: When liquid V is fed into the storage tank the floating body 4 will move upwards with the level of the liquid. Because the pressure has been removed from chamber 9, the ring 6 can likewise slide easily along the vertical inner wall 1 of the tank due to the layer 15 having a low coefficient of friction. As soon as the required level has been reached in the storage tank pressure can be applied from pressure source 12 to chamber 9. As a result a closed connection is effected between the peripheral wall and inner wall 1 of the storage tank and evaporation via the gap thus prevented.

The second embodiment is shown in the FIGS. 2 and 4. In this embodiment the floating covering 4 consists of a layer of sheet-like material 17 floating on the liquid V. The circumferential edge 18 of this layer 17 likewise terminates at an interval from vertical wall 1 of the storage tank. This space is bridged by a closing body 6, which consists of segments 19 of foam substance material, these segments having a hollow core. This hollow core is of a size such that segments 19 can slide onto an annular tube or hose 20. The diameter of hose 20 corresponds with the nominal diameter of the gap between circumferential edge 18 and tank wall 1.

The hose 20 is connected in the manner described above with reference to the FIGS. 1 and 3 to a pressure pump 12 and a control system 13 via a connecting tube 12. The outer periphery of each segment 19 is coated with a layer 21 having a low coefficient of friction, for example Teflon.

The connection between each segment 19 and the circumferential edge 18 of the sheet-like body is effected by means of a releasable coupling, for example a zip fastening 22. The one part of zip fastening 22 can be moulded into the foam substance during forming of the foam substance segment 19.

The storage tank in FIG. 2 is formed with a central stand pipe 23 the space on the bottom of which is in contact with the storage space of the tank. In this way the liquid level in pipe 23 is the same as that of the tank. A float 24 can be arranged in pipe 23 in the usual way for indicating via an indicator system 25 to what degree the tank is filled.

Fitted around stand pipe 23 is a second closing body 26 which likewise takes the form of an annular body of foam substance and which is provided with a hollow core in which is accommodated a tube 27. This tube is also connected to the pressure source via a connecting pipe 11.

The operation of this embodiment is virtually the same as that of the embodiment as according to FIGS. 1 and 3, with the understanding that when the pressure is relieved from the hoses 20 and 27 the closing bodies 19 and 26 respectively are released from the tank wall 1 and stand pipe 23 respectively, so that a free up and downward movement of the floating covering is possible when the liquid is fed in or discharged.

It will be apparent that assembly of this second embodiment is particularly simple, by starting out from a determined length of hose-like tubing 20, which is provided over its full length with segments 19, and by then welding together the ends of the tube 20. The connecting pipe 11 can be fitted at the weld.

The annular closing body 26 can be attached in a simple manner to the sheet-like layer 17 with a suitable adhesive. The inner closing body 26 is also formed with a layer 21 having a low coefficient of friction.

The invention is not restricted to the above described embodiments.

I claim:

1. In a storage tank having a cylindrical side wall with an open top and having an inner surface enclosing a space in which liquid is to be stored, disk-like cover means for floating on the liquid, the cover means having a nominal diameter smaller than the nominal diameter of the inner surface of the side wall to define a circumferential margin providing an annular gap between such circumferential margin and the inner surface of the side wall, annular closing body means joined to the cover means for bridging said gap and effecting a circumferential seal against said inner wall, said annular closing body means comprising an elastic annular body portion defining a gas-tight annular chamber having a nominal diameter greater than that of said circumferential margin but smaller than that of the inner surface and presenting an annular hollow space and an annular body portion of foam material interposed between said annular hollow space and the circumferential margin of the cover means, and pressure control means communicating with said hollow space for selectively pressurizing and releasing pressure from said hollow space.

2. In a storage tank as defined in claim 1 including a layer or body of material having a low coefficient of friction on the surface of the annular closing body means which faces said inner wall.

3. In a storage tank as defined in claim 1 wherein said cover means is in the form of a sheet of flexible material and including zipper means joining said sheet of flexible material to the annular closing body means.

4. In a storage tank as defined in claim 3 wherein said annular closing body means comprises an annulus of foamed material having a hollow interior, said annular elastic body portion being in the form of an endless elastic hose received in said hollow interior.

5. In a storage tank as defined in claim 4 wherein said annulus of foamed material comprises a number of segments threaded onto said hose.

6. In a storage tank as defined in claim 6 wherein said annular closing body means comprises an elastic body defining said chamber presenting said annular hollow space and a second chamber disposed radially inwardly of said hollow space, said second chamber being filled with said foam material.

7. In a storage tank as defined in claim 6 wherein said annular closing body means presents a concave outer margin and including a lens shaped body of material of low coefficient of friction filling such concave outer margin.

8. In a storage tank as defined in claim 1 wherein said annular closing body means comprises an annulus of foamed material having a hollow interior, said annular elastic body portion being in the form of an endless elastic hose received in said hollow interior.

9. In a storage tank as defined in claim 8 wherein said annulus of foamed material comprises a number of segments threaded onto said hose.

10. A floating cover assembly for the liquid content of a storage tank which comprises the combination of a disk-shaped cover having a peripheral edge of lesser diameter than the storage tank so as to present a gap between the cover and the storage tank, an annular closing body bridging the gap, said annular closing body comprising a radially and circumferentially expandable and contractible annulus of composite form, one part of said composite form being an annular part of foamed material bounding the peripheral edge of the cover and a second part of said composite form being an endless annular elastic gas-tight member bounding said annular part of foamed material which bounds the peripheral edge of the cover and defining a pressure chamber, and pressure control means communicating with said pressure chamber for selectively pressurizing and releasing pressure from said pressure chamber to radially and circumferentially expand and contract said annular closing body.

11. A floating cover assembly as defined in claim 10 including a layer or body of material having a low coefficient of friction on the outer surface of the annular closing body which faces said storage tank.

* * * * *